US007798432B2

(12) United States Patent
Dickson et al.

(10) Patent No.: US 7,798,432 B2
(45) Date of Patent: Sep. 21, 2010

(54) DEVICE FOR SPRAYING ANTI-ICING AGENTS ON TRANSPORT SURFACE

(75) Inventors: Charles B. Dickson, Greeley, CO (US); Rodney D. Heiden, Greeley, CO (US)

(73) Assignee: EnviroTech Services, Inc., Greeley, CO (US)

( * ) Notice: Subject to any disclaimer, the term of this patent is extended or adjusted under 35 U.S.C. 154(b) by 0 days.

(21) Appl. No.: 12/054,831

(22) Filed: Mar. 25, 2008

(65) Prior Publication Data

US 2009/0242664 A1 Oct. 1, 2009

(51) Int. Cl.

| | |
|---|---|
| ***B05B 15/08*** | (2006.01) |
| ***B05B 15/06*** | (2006.01) |
| ***B05B 1/02*** | (2006.01) |
| ***B05B 1/00*** | (2006.01) |
| *E01C 11/24* | (2006.01) |

(52) U.S. Cl. ..... 239/596; 239/200; 239/273; 239/600; 404/71

(58) Field of Classification Search ..... 239/200–202, 239/208, 273, 276, 396, 518, 548, 587.1, 239/596, 600; 404/71

See application file for complete search history.

(56) References Cited

U.S. PATENT DOCUMENTS

| | | | |
|---|---|---|---|
| 3,540,655 A | 11/1970 | Hinrichs | |
| 3,662,956 A | 5/1972 | Hedman | |
| 3,814,320 A | 6/1974 | Skurray | |
| 4,188,673 A * | 2/1980 | Carter | 134/167 R |

(Continued)

FOREIGN PATENT DOCUMENTS

| | | |
|---|---|---|
| DE | 3928928 A1 | 3/1991 |

(Continued)

OTHER PUBLICATIONS

PCT International Search Report and Written Opinion, Apr. 13, 2009, 8 pages, PCT/US2009/035117.

(Continued)

*Primary Examiner*—Darren W Gorman
(74) *Attorney, Agent, or Firm*—Townsend and Townsend and Crew LLP

(57) ABSTRACT

The present invention provides a deicing device for spraying anti-icing agents over a transport surface, such as paved road or bridge, to protect the transport surface from snow deposition and ice formation. The deicing device that is surface mounted to the transport surface has a pavement sensor to determine when the deicing device is turned on and off to spray the anti-icing agents. The deicing device comprises a supporting housing, a spray puck having a plurality of nozzles and jet channels connected to the nozzles for spraying anti-icing agents, a lock ring to immobilize the spray buck within the supporting housing, and an O-ring for sealing the anti-icing agents from leaking. The spray puck can be rotated within the supporting housing to change a spray direction. The jet channels have round corners, such as parabolic shape cross-section, to prevent from collection of dirt or debris. The supporting housing is configured for dual stacking such that a second supporting housing is stacked on a first supporting housing to extend the top of the deicing device to be flush with the transport surface when the road is repaved.

17 Claims, 7 Drawing Sheets

U.S. PATENT DOCUMENTS

| | | | | |
|---|---|---|---|---|
| 4,256,261 | A | 3/1981 | Gurney | |
| 4,315,602 | A | 2/1982 | Kubacak et al. | |
| 4,391,005 | A * | 7/1983 | Goettl | 4/490 |
| 4,471,913 | A | 9/1984 | Hofmann | |
| 4,848,666 | A | 7/1989 | Lokken | |
| 4,939,797 | A * | 7/1990 | Goettl | 4/490 |
| 5,447,272 | A | 9/1995 | Ask | |
| 5,964,410 | A | 10/1999 | Brown et al. | |
| 6,047,926 | A | 4/2000 | Stanko et al. | |
| 6,082,638 | A | 7/2000 | Ask et al. | |
| 6,102,306 | A | 8/2000 | Ask et al. | |
| 6,182,767 | B1 | 2/2001 | Jackson | |
| 6,231,313 | B1 | 5/2001 | Heitmann et al. | |
| 6,270,020 | B1 | 8/2001 | Thompson et al. | |
| 6,955,304 | B2 | 10/2005 | Beach et al. | |
| 7,108,196 | B2 | 9/2006 | Kime | |
| 7,137,214 | B2 | 11/2006 | Hoerle et al. | |
| 7,225,999 | B2 | 6/2007 | Foianini et al. | |
| 2004/0046072 | A1 | 3/2004 | Kois | |
| 2004/0050974 | A1 | 3/2004 | Lee et al. | |
| 2004/0124260 | A1 | 7/2004 | Ward et al. | |
| 2005/0072859 | A1 * | 4/2005 | Beach et al. | 239/201 |
| 2006/0113401 | A1 | 6/2006 | Leonhardt et al. | |
| 2006/0180678 | A1 | 8/2006 | Balogh | |
| 2006/0283981 | A1 | 12/2006 | Mead et al. | |
| 2007/0221759 | A1 | 9/2007 | Weyandt et al. | |

FOREIGN PATENT DOCUMENTS

| | | | |
|---|---|---|---|
| EP | 458992 | A1 | 12/1991 |
| EP | 513714 | A1 | 11/1992 |

OTHER PUBLICATIONS

Clines, Kerry L., "Anti-icing System," Boschung America, Better Roads magazine, Aug. 2007, obtained online on Jun. 27, 2008 at http://www.betterroads.com/content/Issue-Story.45.0.html?&no__cache=1&tx__magissue__pi1%5BshowUid%5D=912, p. 1-2 of 7.

Clines, Kerry L., "Pavement Sensor," Energy Absorption Systems/Quixote Transportation Safety, Better Roads magazine, Aug. 2007, obtained online on Jun. 27, 2008 at http://www.betterroads.com/content/Issue-Story.45.0.html?&no__cache=1&tx__magissue__pi1%5BshowUid%5D=912, p. 1 of 7.

Friar, Shawn et al., "Evaluation of a Fixed Anti-Icing Spray System," Journal Transportation Research Record: Journal of the Transportation Research Board, Publisher: Transportation Research Board of the National Academies, ISSN 0361-1981, Issue 1672, vol. 1999, pp. 34-41, online date Jan. 30, 2007.

Presentation at the Partnering with Construction and Maintenance Contractors to Achieve Environmental Protection Session of the 2001 Annual Conference of the Transportation Association of Canada, Halifax, Nova Scotia, May 1, 2001, abstract obtained at http://www.mto.gov.on.ca/English/engineering/anti__ice.htm#description, 3 pages.

* cited by examiner

SECTION A-A

DEVICE FOR SPRAYING ANTI-ICING AGENTS ON TRANSPORT SURFACE

FIELD OF THE INVENTION

This application relates generally to a surface mounted deicing device for spraying anti-icing agents on a paved transport surface such as a road or bridge. The device sprays anti-icing agents in a liquid form through spray nozzles. The anti-icing agents comprises, among others, magnesium chloride ($MgCl_2$), potassium acetate, calcium magnesium acetate, and the like. The deicing device may help reduce accidents caused by ice covered roads or bridges and thus increase the safety margin for travelers on the road.

BACKGROUND OF THE INVENTION

Many deicing devices have been developed to apply anti-icing agents to a transport surface such as a road or bridge. The devices are often surface mounted to the transport. The devices are also flush with the transport surface to avoid interference with vehicles travelling on the transport surface, lessen the probability for the devices to be damaged.

The deicing devices are often installed directly into the road surface by using adhesives or bonding agents when the road is paved. If one or more components of the spray head gets damaged, the spray head is typically removed, which may be difficult or expensive. Alternatively, if the spray head needs to be serviced for defective functions, it may disrupt the traffic.

Additionally, when the road or bridge is repaved, the surface mounted deicing device may be below the transport surface. Alternatively, when the paved surface is worn down, the deicing device may protrude above the surface. This situation may accelerate the surface wear of the deicing device. Furthermore, the deicing device often collects dirt or debris that may affect the spray of the anti-icing agents.

Therefore, there remains a need for deicing devices that are adjustable and flexible. There still remains a need for reducing surface wear of the deicing device to extend service life of the deicing device. There remains a further need for reduced contamination when the deicing device is in service.

BRIEF SUMMARY OF THE INVENTION

Embodiments of the invention pertain to techniques for increasing flexibility and adjustability in deicing devices. Spray heads of the deicing devices may be rotatable for covering targeted transport surface. The height of the deicing device may be adjustable to extend a top surface of the deicing device to be flush with the transport surface when the transport road is repaved or resurfaced. A flow rate or droplet size of the anti-icing agent spray may be adjusted to meet desired requirements. A spray angle of spray channels may also be adjusted to cover small or larger surface area. The deicing device may also include rounded corners in the jet channels to be less likely to collect and retain dirt or debris. The deicing device may have improved dimensional stability and wear resistance.

Embodiments of the invention include a deicing device for spraying anti-icing agents over a transport surface, such as paved road or bridge, to protect the transport surface from ice formation. The deicing device that is surface mounted to the transport surface has a pavement sensor. The sensor is used to determine when the deicing device is turned on and off to spray the anti-icing agents. The deicing device comprises a supporting housing, a spray puck having a plurality of nozzles and jet channels connected to the nozzles for spraying anti-icing agents, a lock ring to immobilize the spray puck within the supporting housing, and an O-ring for sealing the anti-icing agents from leaking. The spray puck can be rotated within the supporting housing to change a spray direction. The spray puck is then locked in a changed spray direction, for example, by using a plurality of fasteners.

In additional embodiments of the invention, at least one insert may be disposed into one of the nozzles. The insert may be shaped in a form of a tube. An inner diameter of the insert has a variable size to allow adjustment in flow rate. The jet channels connected to the nozzles have a variable angle for adjusting spray direction vertically. This angle may be set at various values when the spray puck is machined. The jet channels on the spray puck have a cross section with round corners. In a preferred embodiment of the invention, the cross section has a parabolic shape.

In still more embodiments of the invention, the spray puck with nozzles and channels comprises a plastic that is substantially non-hygroscopic and wear resistant. For example, the device may include a polyacetal plastic such as Delrin® from DuPont. Polyacetal is less sensitive to dimensional changes and degradation in mechanical properties because of less moisture absorption. Polyacetal also has wear resistance and low friction.

In further embodiments of the invention, the bottom of the supporting housing may be configured to be attachable to the top of the supporting housing to extend a top surface of the device to be flush with the transport surface. The overall thickness of one supporting housing may vary from another supporting housing.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and drawings.

DETAILED DESCRIPTION OF THE INVENTION

Figure 1A:
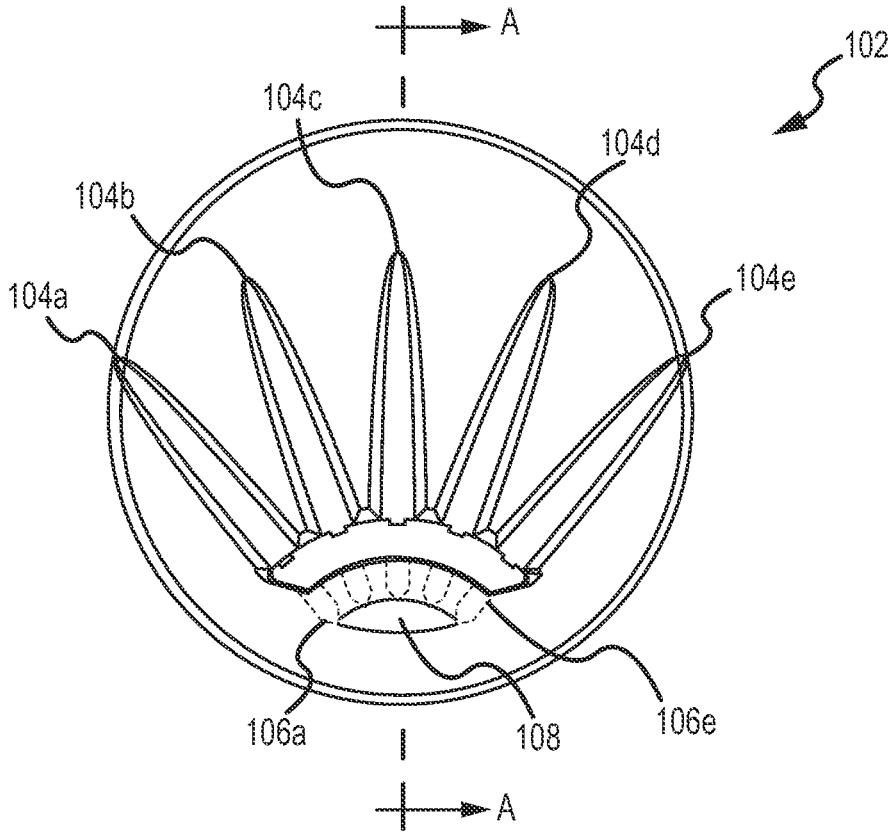
FIGS. 1A, 1B and 1C are a schematic top view, side view and lateral view of a spray puck of a deicing device, according to embodiments of the invention.
Figure 1B:
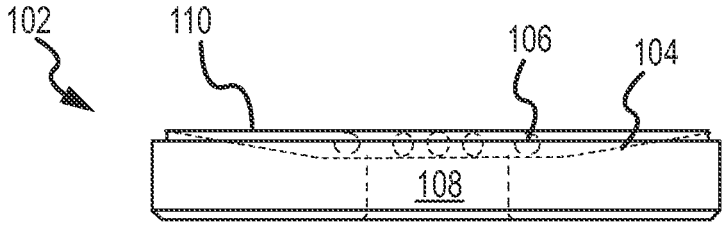
Figure 1C:
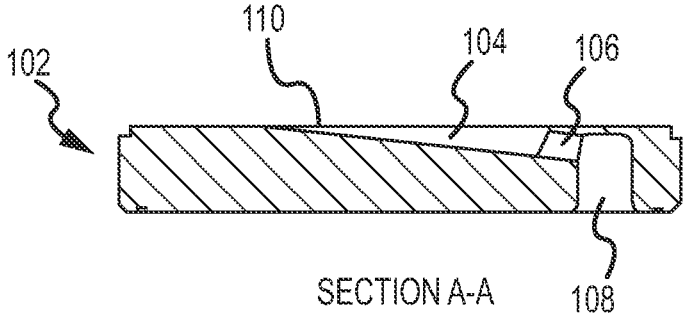

An exemplary deicing device is illustrated in FIGS. 1A-C. The deicing device may include a spray puck, a supporting housing, a lock ring, and O-ring among other features. FIGS. 1A, 1B and 1C show a top view, a side view and a lateral view respectively of the spray puck 102. FIG. 1A shows an embodiment of a spray puck 102 having a plurality of jet channels 104*a*, 104*b*, 104*c*, 104*d* and 104*e* connected to a plurality of nozzles 106*a*-106*e*, respectively. The nozzles 106 may be in a fluid communication with an inlet 108 for flowing anti-icing agents. The jet channels may have round corners that form a parabolic shaped cross-section in the channels , as shown merely by way of example in FIG. 1E. The round corners can help reduce the retention of dirt or debris in the jet channels and nozzles.

In FIG. 1B, the nozzles 106 are shown in a substantially circular shape with a hollow center. The nozzles 106 are spaced out to provide a fan-shaped spray coverage of a transport surface. The jet channels 104 are angled relative to the top surface 110 of the spray puck 102. This angle may vary for a plurality of jet channels 104 on the spray puck 102, or vary for different spray pucks. The jet channels 104 may have a larger or smaller angle to the transport surface. To adjust the spray direction vertically to provide desired surface coverage, the angle may be selected for a particular spray puck when the deicing device is installed. This angle may be set at various values when the spray puck is machined.

Figure 1D:
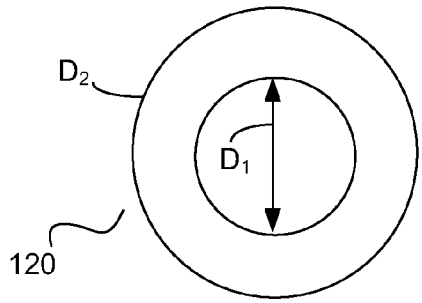
FIG. 1D is a cross-sectional view of a simplified insert.
Figure 1E:
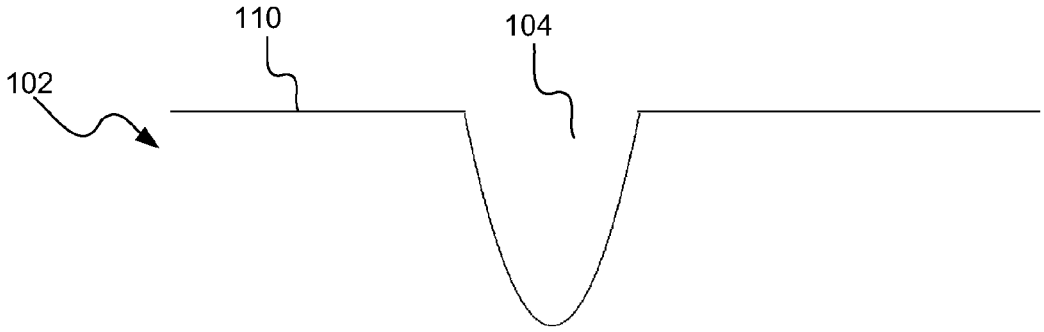
FIG. 1E is a partial cross-sectional view of a spray puck of a deicing device showing a jet channel with round corners that form a parabolic shaped cross-section in the channel, in accordance with various embodiments.

The nozzle 106 may be connected between the inlet 108 and jet channel 104 to allow the anti-icing agents to be supplied in from the inlet and sprayed through the nozzle 106 and the jet channel 104 as shown in FIG. 1C. As shown in FIG. 1D, an insert 120 of a substantially tube shape with a variable inner diameter $D_1$ may be disposed into the nozzle 106 for adjusting flow rate. The outer diameter $D_2$ needs to be sized to fit into the nozzle 106. The inner diameter D of the insert may be sized for required flow rate or droplet size. The insert 120 may comprise a metal such as stainless steel. To increase flow rate, an insert 120 of a larger diameter may be used. Similarly, to reduce flow rate an insert 120 of a smaller diameter may be inserted into the nozzle.

Figure 2A:
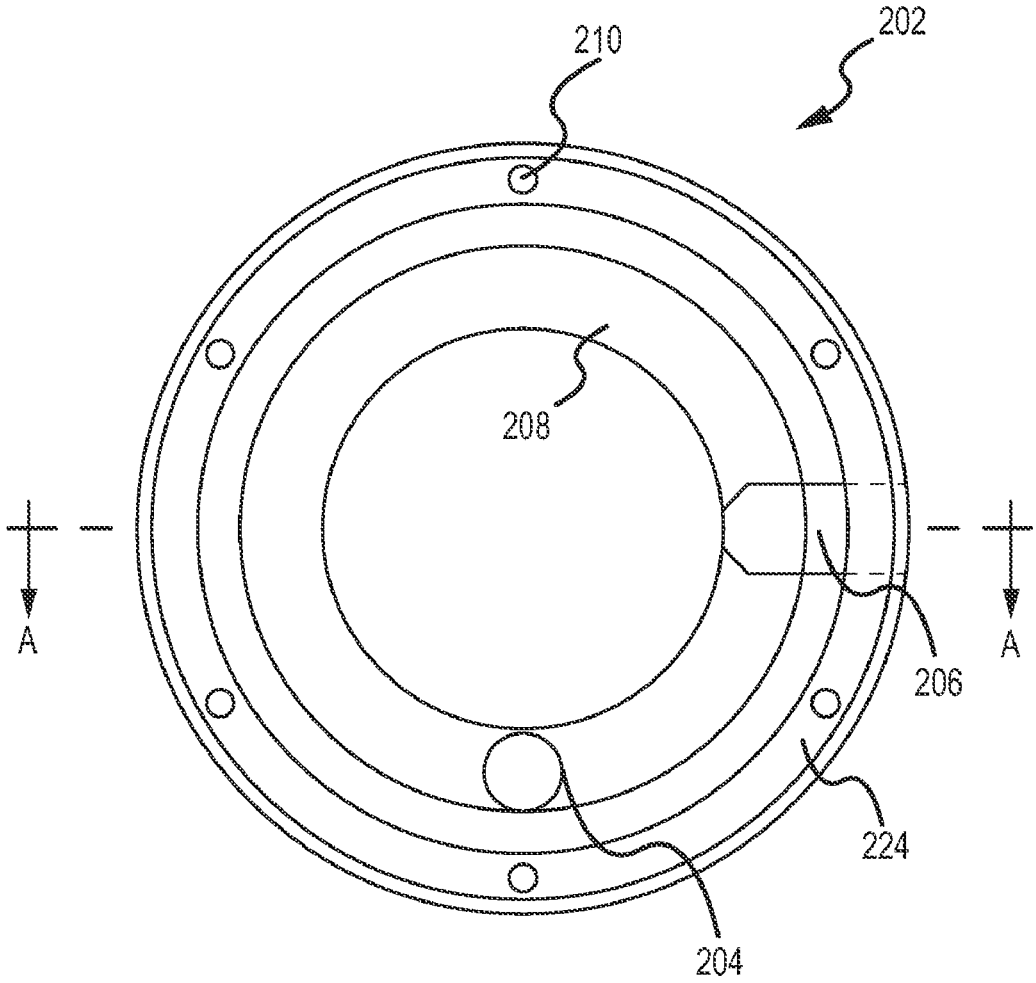
FIGS. 2A and 2B are schematic top and side views of a support housing of the deicing device, according to embodiments of the invention.
Figure 2B:
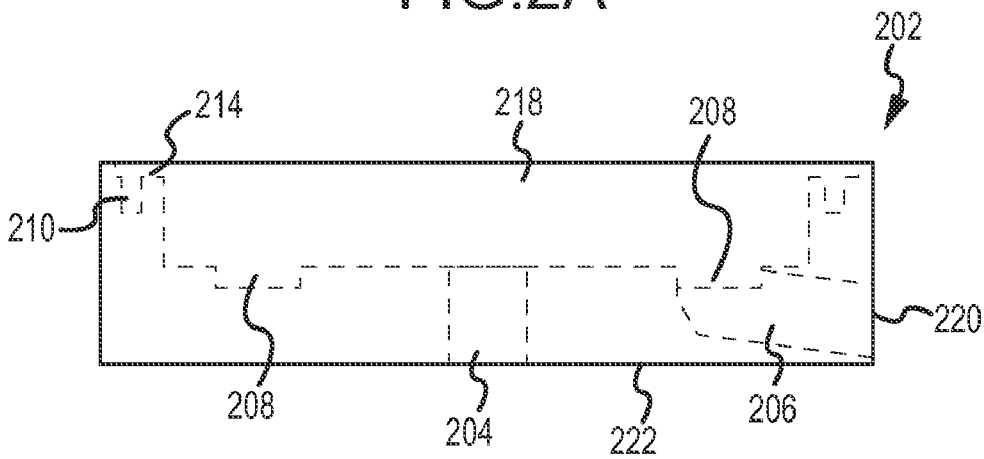

FIGS. 2A and 2B show an embodiment of a top view and a side view of the supporting housing 202. Note that the supporting housing 202 has a center recess or cavity 218, in which the spray puck 102 is disposed. The supporting housing 202 has an annular flange 224 with a plurality of mounting holes 210 (shown here with six holes), and the flange 224 surrounds the center recess 218. The spray puck 102 can be rotated within the supporting housing 202 to a desired position. Then, fasteners can be tightened in the mounting holes 210 for locking the spray puck 102 in the desired position. The supporting housing 202 provides an inlet 206 on the side surface 220. The inlet 206 is connected to a fluid conduit 208 that has a recess for flowing the anti-icing agents from a reservoir. The recess 212 may be annular shaped as shown in FIG. 2A. The supporting housing 202 may also has an inlet 204 near the bottom surface 222 for flowing the anti-icing agents from a reservoir. The inlet 204 is connected to the fluid conduit 208. The inlet 108 of the spray puck 102 is in a fluid communication with the fluid conduit 208 of the supporting housing 202 when the spray puck 102 is disposed within the supporting housing 202.

Figure 3:
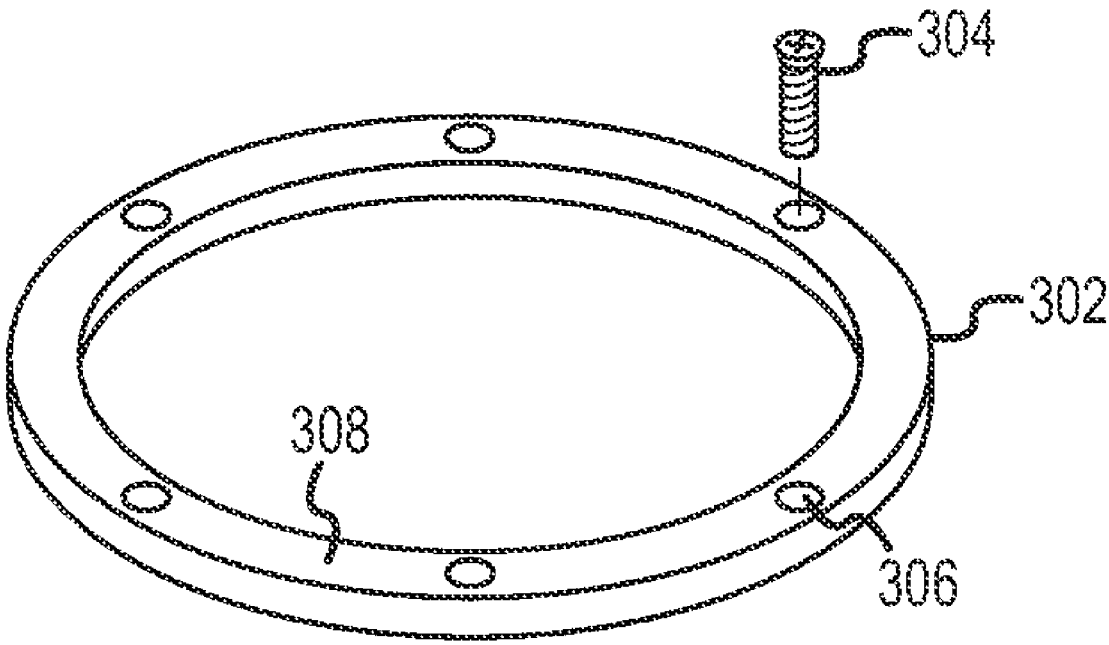
FIG. 3 is a schematic of a lock ring, according to embodiments of the invention.

FIG. 3 shows a schematic of the lock ring 302 with a fastener 304. The lock ring 302 has a plurality of through-holes 306 (e.g. 6). The lock ring 302 is used to hold the spray puck 102 within the supporting housing 202.

Figure 4A:
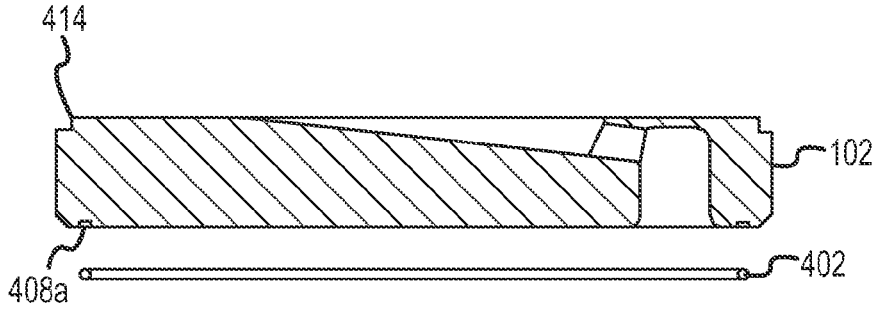
FIG. 4A is a simplified schematic of a partially exploded view of an O-ring with the spray puck, according to embodiments of the invention.

An O-ring is a loop of elastomer with a round cross-section used as a mechanical seal. It is seated in a groove and compressed during assembly of the spray puck 102 and the support housing 202 and creates a seal at the interface to prevent the anti-icing agents from leaking. FIG. 4A shows an O-ring 402 near the bottom of the spray puck 102. The O-ring 402 has an annular ring shape and is fitted into the groove 408*a* at the bottom of the spray puck 102. Note that there is a cutoff annular edge 414 on the spray puck 102. The cutoff annular edge 414 is designed for the lock ring 302 to sit on to lock the spray puck 102 within the supporting housing 202.

Figure 4B:
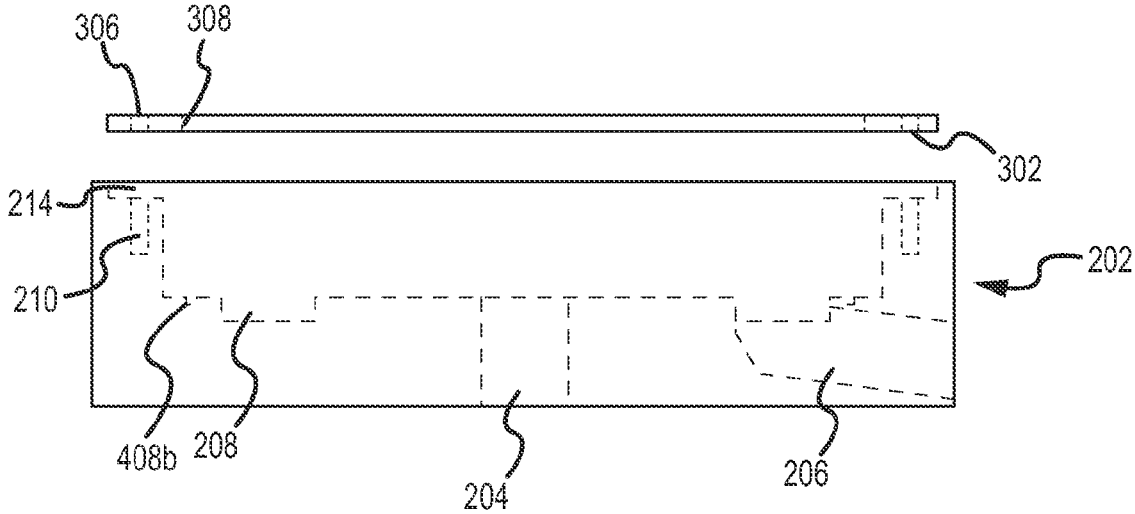
FIG. 4B is a simplified schematic of a partially exploded view of a lock ring with the support housing, according to embodiments of the invention.

FIG. 4B shows the lock ring 302 above the supporting housing 202. The through-holes 306 on the lock ring 302 are aligned with the mounting holes 210 in the supporting housing 202. The fasteners 304 can tighten through the holes 306 in the mounting holes 210. The inner diameter 308 of the lock ring 302 is determined such that the lock ring 302 settles on the cutoff edge 414 of the spray puck 102 when the spray puck 102 is locked within the supporting housing 202. Note that the lock ring 302 settles on both the shoulder 214 of the supporting housing 202 and the cutoff edge 414 of the spray puck 102 when the spray puck 102 is assembled within the supporting housing 202. In addition, an annular recess 408*b* in the supporting housing 202 is for the O-ring 402 to be disposed. The O-ring 402 helps seal the anti-icing agents from leaking.

Figure 4C:
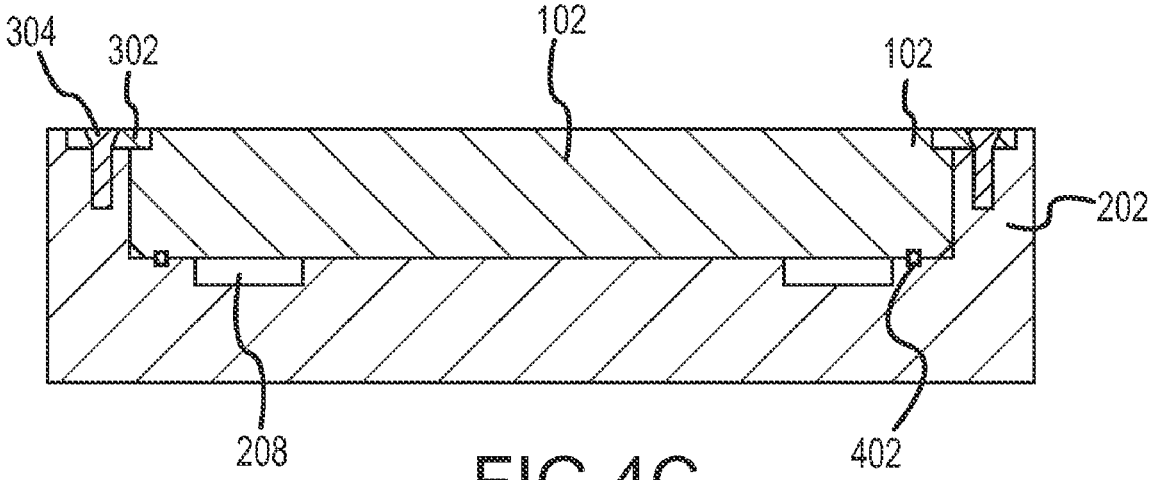
FIG. 4C is a schematic of an assembled deicing device, according to embodiments of the invention.

FIG. 4C shows a schematic of deicing device assembly, i.e. the spray puck 102 is assembled within the supporting housing 202 by using fasteners 304 to tighten the lock ring 302. The O-ring 402 fits between the recess 408*a* of the spray puck 102 and the recess 408*b* of the supporting housing 202 by applying a pressure.

The spray puck 102 and the supporting housing 202 may comprise a plastic that is non-hydroscopic and wear resistant. The plastic may be a polyacetal, that is often referred by a trade name Delrin manufactured by DuPont. This material has similar wear resistance like nylon, but has better resistance to water absorption and thus better dimensional stability than nylon. Another benefit of using the plastic is its inherently resistance to corrosion, especially with anti-icing agents around. The spray puck and supporting housing may also comprise a metal, such as stainless steel, or any composite and the like.

The deicing device allows the spray puck 102 to be rotated within the support housing 202. For example, the fasteners 304 on the deicing device may be loosen to allow the movement of the spray puck 102 within the support housing 202. Once the spray puck 102 is rotated to a desired position to maximize the coverage area of the transport surface, the spray puck 102 is locked into the position by the lock ring 302. One way of holding the lock ring 302 is to tighten a set of fasteners 304 in the mounting holes 210 of the support housing 202.

Figure 5A:
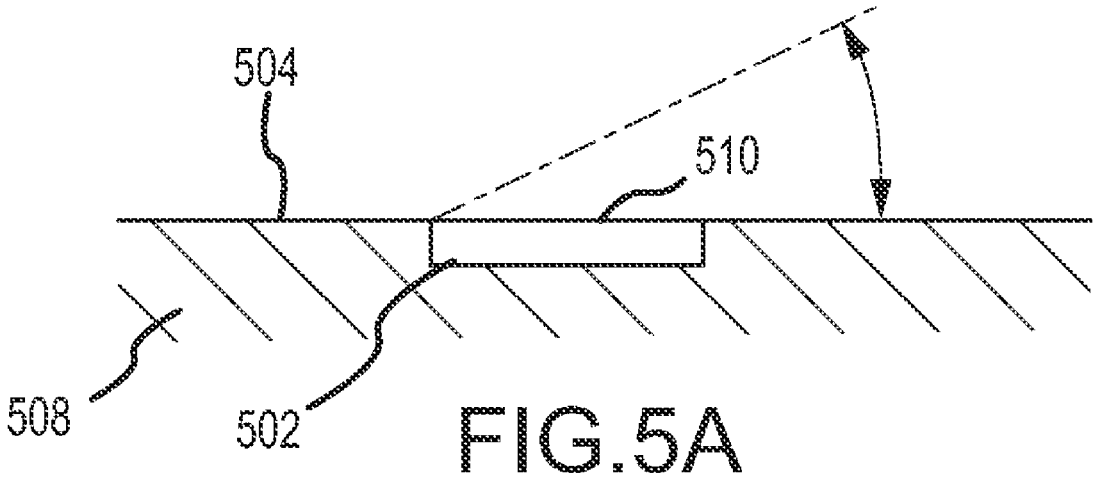
FIGS. 5A and 5B are side and top views of a schematic for the deicing device surface mounted in a transport surface, according to embodiments of the invention.
Figure 5B:
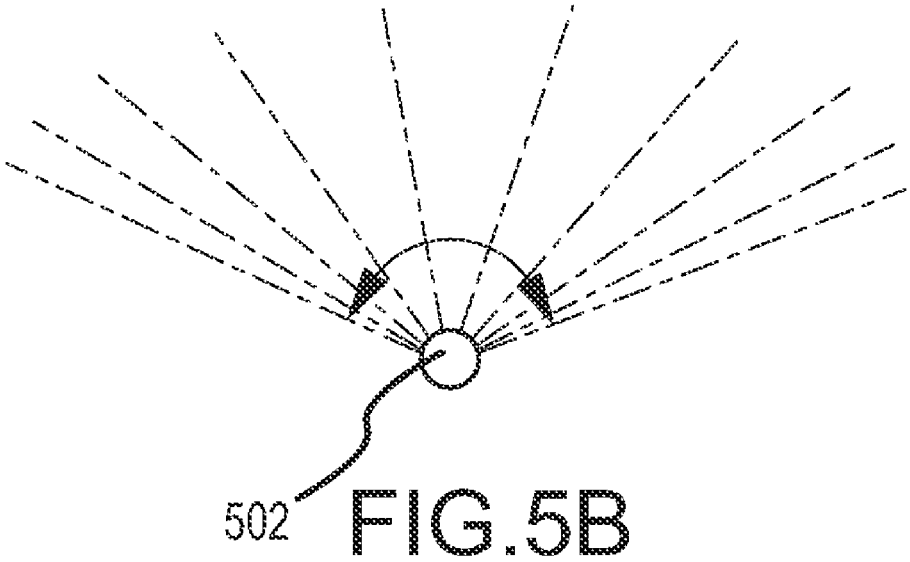

FIG. 5A shows the deicing device 502 is mounted into a transport road 508. The top surface 510 of the deicing device 502 is flush with the transport surface 504. The deicing device 502 can spray the anti-icing agents at an angle. FIG. 5B shows the top view of the deicing device 502 to have a fan-shaped spray of the anti-icing agents to cover an angle less than 180°.

In one embodiment, a pavement sensor may be attached to the deicing device. The pavement sensor is a digital device designed to provide current information on pavement conditions. The sensor may measure road surface temperature, moisture, humidity, traffic of a transport surface and the like. The sensor may also include algorithms that allow to predict if frost dew is likely to form on the road. The active capabilities of the sensor allow road maintenance personnel to receive accurate freeze-point calculations of a road surface and to detect frost or ice on the road. The sensor generates all the data needed to activate the deicing device 502.

A valve connected to the inlet of supporting housing 202 may be controlled by the pavement sensor through a controller. The controller may determine the time to turn on/off the valve. The controller may also determine spray time, flow rate, flow pressure, etc.

The deicing device 502 may be placed into a recess area from the transport surface and bonded to the transport surface with a bonding agent, such as an adhesive, epoxy or the like. A groove at the bottom of the supporting housing 202 accommodates the bonding agent to form a strong bond between the transport road 508 and the supporting housing 202. The deicing device 502 is flush mounted to the transport surface 504. Installation assembly and wear indicators are described in a patent application U.S. Pat. No. 6,102,306, entitled "Multifunctional Flush Surface Nozzle," by Bernard J. Ask, Tom Ask, which is incorporated herein by reference for all purposes.

In a specific embodiment of the invention, when the transport road is repaved or resurfaced, a second supporting housing 202 of the deicing device 502 may be stacked to the first supporting housing 202 to extend the top surface of the deicing device 502 to be flush with the transport surface 504. The bottom of the supporting housing 202 is grooved to allow the supporting housing 202 to sit on the top of the supporting housing 202. The dual stacking of the supporting housing 202 may be bonded by an adhesive, or mechanical fasteners, and the like. The overall thickness of the second supporting housing may vary from the first supporting housing.

Thus, having described several embodiments, it will be recognized by those of skill in the art that various modifications, alternative constructions, and equivalents may be used without departing from the spirit of the invention. Examples of possibly variations may include but not limited to varying shapes and dimensions of the spray puck, nozzles, inserts, jet channels, techniques of stacking of supporting housings, and the like. Accordingly, the above description should not be taken as limiting the scope of the invention, which is defined in the following claims.

What is claimed is:

1. A device for spraying anti-icing agents on a transport surface, the device comprising:

a supporting housing having a recess surrounded by a flange, wherein the supporting housing has an inlet for flowing anti-icing agents into the supporting housing, wherein the supporting housing has a fluid conduit that is connected to the inlet for circulating the anti-icing agents;

a rotatable spray puck having at least one nozzle and one jet channel being connected downstream to the nozzle for spraying the anti-icing agents, wherein the spray puck is disposed inside the supporting housing, wherein a top surface of the spray puck is flush with a top surface of the flange; and wherein the spray puck is adapted to be in a fluid communication with the fluid conduit; and a lock ring to removably secure the rotatable spray puck inside the supporting housing.

2. The device for spraying anti-icing agents on a transport surface of claim 1, wherein an O-ring is positioned between the rotatable spray puck and supporting housing for preventing the anti-icing agents from leaking.

3. The device for spraying anti-icing agents on a transport surface of claim 1, wherein at least one insert is disposed into the nozzle for adjusting flowing rate, the insert being shaped in a form of a tube to allow the anti-icing agents to flow through the center of the inserts.

4. The device for spraying anti-icing agents on a transport surface of claim 3, wherein the insert is a replaceable component having a variable size.

5. The device for spraying anti-icing agents on a transport surface of claim 3, wherein the insert comprises a metal.

6. The device for spraying anti-icing agents on a transport surface of claim 1, wherein the jet channel has a first angle and a second jet channel has a second angle for vertically changing spraying direction over the transport surface.

7. The device for spraying anti-icing agents on a transport surface of claim 1, wherein a cross section of the jet channel comprises round corners for preventing blockage from collection of debris.

8. The device for spraying anti-icing agents on a transport surface of claim 7, wherein the cross section of the jet channel comprises a parabolic shape.

9. The device for spraying anti-icing agents on a transport surface of claim 1, wherein a plurality of nozzles are positioned such that the nozzles spray the anti-icing agents to cover a fan-shaped area of the transport surface.

10. The device for spraying anti-icing agents on a transport surface of claim 9, wherein the surface coverage angle of spraying from the device is less than 180 degrees.

11. The device for spraying anti-icing agents on a transport surface of claim 1, wherein a position of the rotatable spray puck is adjustable within the supporting housing to horizontally change a spray direction over the transport surface.

12. The device for spraying anti-icing agents on a transport surface of claim 1, wherein the rotatable spray puck and the supporting housing comprise a plastic, the plastic being substantially non-hygroscopic and wear resistant.

13. The device for spraying anti-icing agents on a transport surface of claim 12, wherein the plastic comprises polyacetal.

14. The device for spraying anti-icing agents on a transport surface of claim 1, wherein the lock ring comprises a metal.

15. The device for spraying anti-icing agents on a transport surface of claim 14, wherein the metal comprises stainless steel.

16. The device for spraying anti-icing agents on a transport surface of claim 1, wherein a bottom of the supporting housing is configured to be attachable to a top of another supporting housing to extend the top surface of the device to be flush with the transport surface.

17. A device for spraying anti-icing agents on a transport surface, the device comprising:

a supporting housing having a recess surrounded by a flange, wherein the supporting housing has an inlet for flowing anti-icing agents into the supporting housing, wherein the supporting housing has a fluid conduit that is connected to the inlet for circulating the anti-icing agents, and wherein the flange has a first plurality of holes;

a rotatable spray puck having at least one nozzle and one jet channel being connected to the nozzle for spraying the anti-icing agents, wherein the spray puck is disposed inside the supporting housing and adapted to be in a fluid communication with the fluid conduit, wherein a top surface of the spray puck is flush with a top surface of the flange; and a lock ring to removably secure the rotatable spray puck inside the supporting housing, wherein the lock ring has a second plurality of through-holes, and a plurality of fasteners are tightened through the second plurality of through-holes into the first plurality of holes.

* * * * *